US009662532B2

(12) United States Patent
Boss

(10) Patent No.: US 9,662,532 B2
(45) **Date of Patent: *May 30, 2017**

(54) EXERCISE MACHINE

(71) Applicant: Dimitry Ralph Boss, Hillsdale, NJ (US)

(72) Inventor: Dimitry Ralph Boss, Hillsdale, NJ (US)

( * ) Notice: Subject to any disclaimer, the term of this patent is extended or adjusted under 35 U.S.C. 154(b) by 32 days.

This patent is subject to a terminal disclaimer.

(21) Appl. No.: 14/995,128

(22) Filed: Jan. 13, 2016

(65) Prior Publication Data

US 2016/0213968 A1 Jul. 28, 2016

Related U.S. Application Data

(60) Provisional application No. 62/104,054, filed on Jan. 15, 2015.

(51) Int. Cl.

| | |
|---|---|
| ***A63B 21/00*** | (2006.01) |
| ***A63B 21/068*** | (2006.01) |
| ***A63B 21/16*** | (2006.01) |
| ***A63B 23/02*** | (2006.01) |
| ***A63B 69/00*** | (2006.01) |

(52) U.S. Cl.

CPC ..... *A63B 21/16* (2013.01); *A63B 21/068* (2013.01); *A63B 21/4013* (2015.10); *A63B 21/4029* (2015.10); *A63B 21/4049* (2015.10); *A63B 23/0211* (2013.01); *A63B 23/0227* (2013.01); *A63B 69/0057* (2013.01); *A63B 21/1654* (2013.01); *A63B 21/4034* (2015.10); *A63B 2069/0062* (2013.01); *A63B 2208/0233* (2013.01); *A63B 2208/0247* (2013.01); *A63B 2208/0252* (2013.01); *A63B 2208/0266* (2013.01); *A63B 2210/50* (2013.01); *A63B 2225/09* (2013.01); *A63B 2225/093* (2013.01)

(58) Field of Classification Search

CPC ..... A63B 21/00047; A63B 21/00185; A63B 21/068; A63B 21/4011–21/4015; A63B 23/0205–23/0211; A63B 2069/0062

See application file for complete search history.

(56) References Cited

U.S. PATENT DOCUMENTS 4,591,148 A 5/1986 Slater
4,629,179 A 12/1986 Bizilia
(Continued)

*Primary Examiner* — Loan H Thanh
*Assistant Examiner* — Jennifer M Deichl
(74) *Attorney, Agent, or Firm* — Quickpatents, LLC; Kevin Prince

(57) ABSTRACT

An exercise apparatus includes foot docking station comprising a base plate pivotally fixed to a back plate at a hinge. The back plate includes a central pivot rotationally fixed with a foot plate that includes a shin engagement mechanism for engaging the shins of the person. The foot docking station further includes a first receiver for engaging a lower bench. At least one distal leg is fixed with the lower bench at a rotational leg mount, the lower bench including a second receiver for engaging an upper bench. At least one proximal leg is fixed with the upper bench at another rotational leg mount. A top side of the upper bench includes a track upon which a bench trolley slides. The bench trolley includes at least one cushion, a pair of laterally extending handles, and at least a first pair of wheels that engage the track.

17 Claims, 12 Drawing Sheets

(56) References Cited

U.S. PATENT DOCUMENTS

| | | | | |
|---|---|---|---|---|
| 6,231,487 | B1 * | 5/2001 | Diamond, Jr. ..... | A63B 21/026 482/121 |
| 7,407,467 | B2 * | 8/2008 | Diamond, Jr. ..... | A63B 21/4025 482/121 |
| 8,066,621 | B2 | 11/2011 | Carlson | |
| 8,360,941 | B2 | 1/2013 | Kristiansen | |
| 8,529,416 | B2 * | 9/2013 | Jennings ..... | A63B 21/015 482/114 |
| 8,574,134 | B2 | 11/2013 | Greenburg | |
| 2007/0176369 | A1 * | 8/2007 | Sellke ..... | A63B 63/004 273/407 |
| 2014/0148315 | A1 | 5/2014 | Thompson | |

* cited by examiner

EXERCISE MACHINE

CROSS-REFERENCE TO RELATED APPLICATIONS

This application claims the benefit of U.S. Provisional Patent Application 62/104,054, filed on Jan. 15, 2015, and incorporated herein by reference.

STATEMENT REGARDING FEDERALLY SPONSORED RESEARCH AND DEVELOPMENT

Not Applicable.

FIELD OF THE INVENTION

This invention relates to exercise devices, and more particularly to a multi-use exercise bench and foot docking station.

DISCUSSION OF RELATED ART

The prior art is replete with exercise devices for allowing a user to perform a number of different exercise. Often it is desired that exercise devices allow for a large number of different exercises that exercise a multiple number of muscle groups, such as the torso, core, mid-section, rectus abdominals, transversus abdominis, lower back, internal oblique, external oblique, latissimus dorsi, serratus anterior, serratus posterior inferior, erector spinae, external intercoastal, gluteus maximus, and gluteus medius muscle groups. Heretofore, however, any exercise device that purports to allow exercise of many of these muscle groups is relatively bulky and difficult to transport, store and use.

Therefore, there is a need for a device that allows exercising of all of these muscle groups through versatile adjustment of height, angle, and rotation of various components thereof. Such a needed device would be relatively compact when collapsed into a retracted position for ease of transportation and storage. Such a needed invention would further be relatively inexpensive to manufacture, and easy to set-up, reconfigure and use. The present invention accomplishes these objectives.

SUMMARY OF THE INVENTION

The present device is an exercise apparatus for use by a person on a support surface, such as a floor. A foot docking station comprises a base plate pivotally fixed to a back plate at a hinge. The back plate includes a central pivot rotationally fixed with a bottom side of a foot plate. The rotational hinge preferably includes a selectively adjustable tightening knob adapted to lock the rotational position of the back plate and foot plate with the base plate.

The foot plate has a shin engagement mechanism extending away from a top side thereof for engaging the shins of the person while the person's feet contact the top side of the foot plate, or at least a cushion affixed thereto. The shin engagement mechanism includes a pair of U-shaped shin pads projecting laterally away therefrom.

Preferably the base plate and foot plate further include a rotational locking mechanism adapted for selectively locking the relative rotational position between the back plate and the foot plate. The base plate further includes a weight rod projecting upwardly therefrom and adapted to receive at least one annular weight thereon. Alternately, a door or other heavy item may be engaged with the weight rod or base plate to maintain the base plate on the support surface.

The foot docking station further includes a first receiver and the exercise apparatus further includes a lower bench. The lower bench comprises an elongated lower shaft having a distal end adapted for engaging the first receiver of the foot docking station, and a proximal end.

In one embodiment, each of two rigid distal legs is fixed with the distal end of the lower shaft at a rotational leg mount. The distal legs are positionable between a retracted position aligned with and adjacent to the lower shaft, and an extended position extending beyond the distal end of the lower shaft. The rotational leg mount includes a rotational lock adapted for selective locking of the relative rotational position of the legs and the lower shaft. The legs preferably each terminate at a distal end thereof with a surface grip.

As such, with the proximal end of the lower shaft and the surface grips of each leg contacting the support surface, the height and angle of the foot docking station and the lower bench may be selected for performing the exercise.

The first embodiment of the distal legs may also include, at the proximal end of each distal leg, a vertical pivot adapted to allow the distal leg to pivot laterally outwardly away from the distal end of the lower shaft. The vertical pivot is captured within a pivot housing that may further include a plurality of pin stops. In such an embodiment, the proximal end of each leg further includes a spring-biased pin adapted for engaging any of the plurality of pin stops of the pivot housing to selectively lock the pivoting position of the leg with respect to the lower shaft.

In a second and preferred embodiment of the legs of the invention, the pair of legs takes the form of a single T-shaped leg having a main shaft and two laterally projecting shafts. An axle traverses a proximal end of the T-shaped leg and a pivot aperture of a second pivot housing. The pivot housing further includes at least one locking plate through which a locking pin can engage any one of a plurality of pin stops to selectively lock the relative rotational position of the T-shaped leg and the lower shaft. The distal end of the lower shaft and the first receiver of the foot docking station may include a pin locking mechanism, such that a locking pin may be selectively used to lock the foot docking station to the distal end of the lower shaft.

The proximal end of the lower shaft of the lower bench further includes a second receiver for engaging an upper bench. An elongated upper shaft has a distal end adapted for engaging the second receiver of the lower shaft, and a proximal end. At least one proximal leg is fixed with the proximal end of the upper shaft at a rotational leg mount at a proximal end thereof, identically to either the first or second embodiment of the at least one distal leg except oriented-degrees such that the at least one proximal leg may extend beyond the proximal end of the upper shaft when in its extended position. Each proximal leg terminates at a distal end thereof with the surface grip.

In such an embodiment, the distal end of the upper shaft and the second receiver of the lower shaft include a second pin locking mechanism, such that a locking pin may be used to selectively lock the proximal end of the lower shaft to the distal end of the upper shaft.

A top side of the upper shaft includes a track upon which a bench trolley slides between the proximal and distal ends of the upper shaft. The bench trolley includes at least one cushion at a top side thereof, a pair of laterally extending handles, and at least a first pair of wheels that engage the track. The bench trolley may further include a lumbar support cushion extending away from a distal side thereof.

The track preferably includes a plurality of locking apertures and the bench trolley includes a pin aperture. As such, the bench trolley can be locked into position with respect to the track by inserting a locking pin through the pin aperture of the bench trolley and one of the plurality of locking apertures of the track. The track further may include at least one pair of wheel cut-outs, the bench trolley including a wheel post extending through the track of the upper shaft and terminating in a second pair of wheels that engage an inside surface of the upper shaft. As such, when the second pair of wheels is aligned with the cut-outs the bench trolley can be removed from the upper bench.

Preferably a third pair of wheels extends past the proximal end of the upper shaft. The foot docking station, in such an embodiment, includes a pulling handle formed in a distal end of the base plate. As such, with the proximal and distal legs, each in their retracted positions, the pulling handle of the foot docking station may be lifted and pulled to roll the apparatus along the support surface upon the third pair of wheels. Similarly, the distal end of the lower shaft may also include one of the pulling handles such that the apparatus may be rolled along the support surface even if the foot docking station is removed from the lower shaft.

An auxiliary bench may be attached to the upper and lower benches, by removing the bench trolley and, optionally, the foot docking station. The auxiliary bench may be selectively attached to the upper and lower benches, or to the track, at a pair of mechanical fasteners. An optional seat attachment may be selectively fixed with the distal end of the auxiliary bench. As such, by positioning the proximal and distal legs, in their various positions, the auxiliary bench may be reclined, inclined, or level.

The present device allows exercising of the torso, core, mid-section, rectus abdominals, transversus abdominis, lower back, internal oblique, external oblique, latissimus dorsi, serratus anterior, serratus posterior inferior, erector spinae, external intercoastal, gluteus maximus, and gluteus medius muscle groups through versatile adjustment of height, angle, and rotation of various components of the apparatus. The present device is relatively compact when collapsed into a retracted position for ease of transportation and storage, and is relatively inexpensive to manufacture, easy to set-up, reconfigure and use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
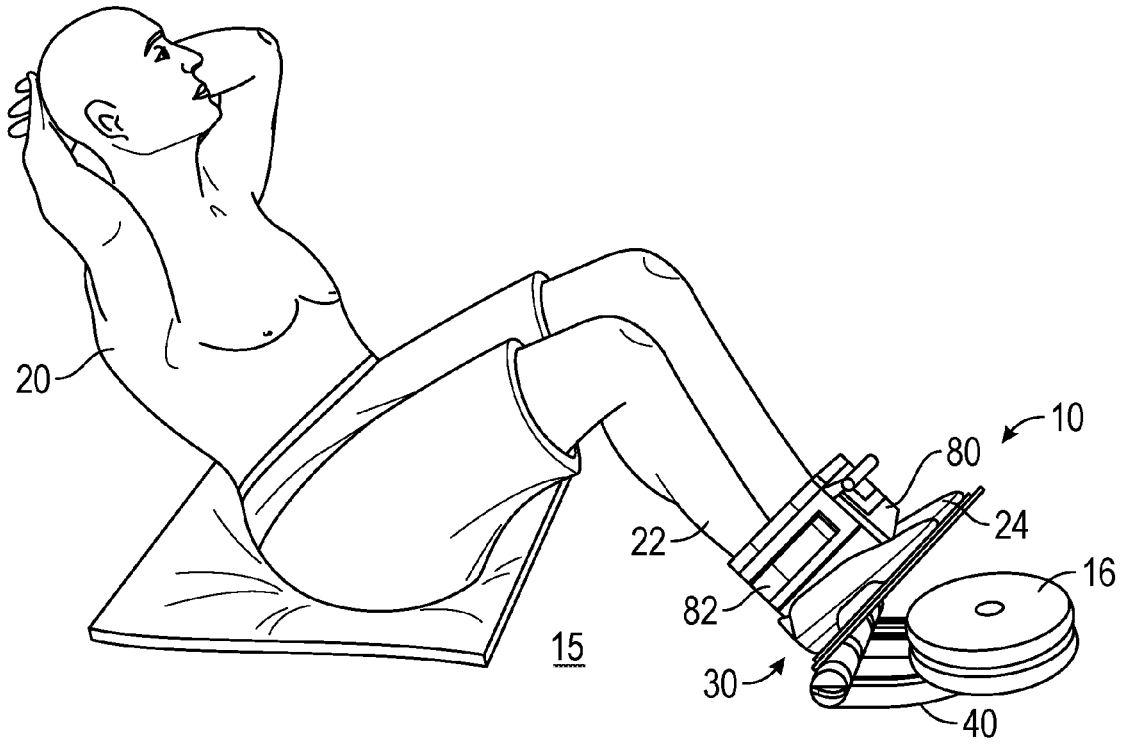
FIG. 1 is a perspective view of a foot docking station of the invention, illustrated as used by an exerciser.
Figure 2:
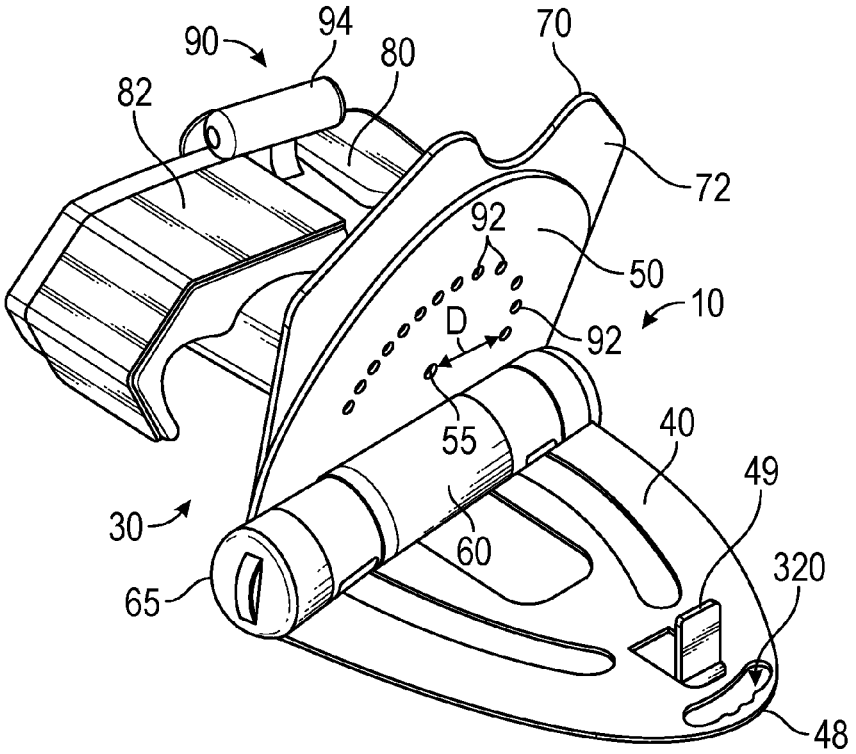
FIG. 2 is an enlarged perspective view of the foot docking station as shown in FIG. 1, but without weights attached thereto.
Figure 3:
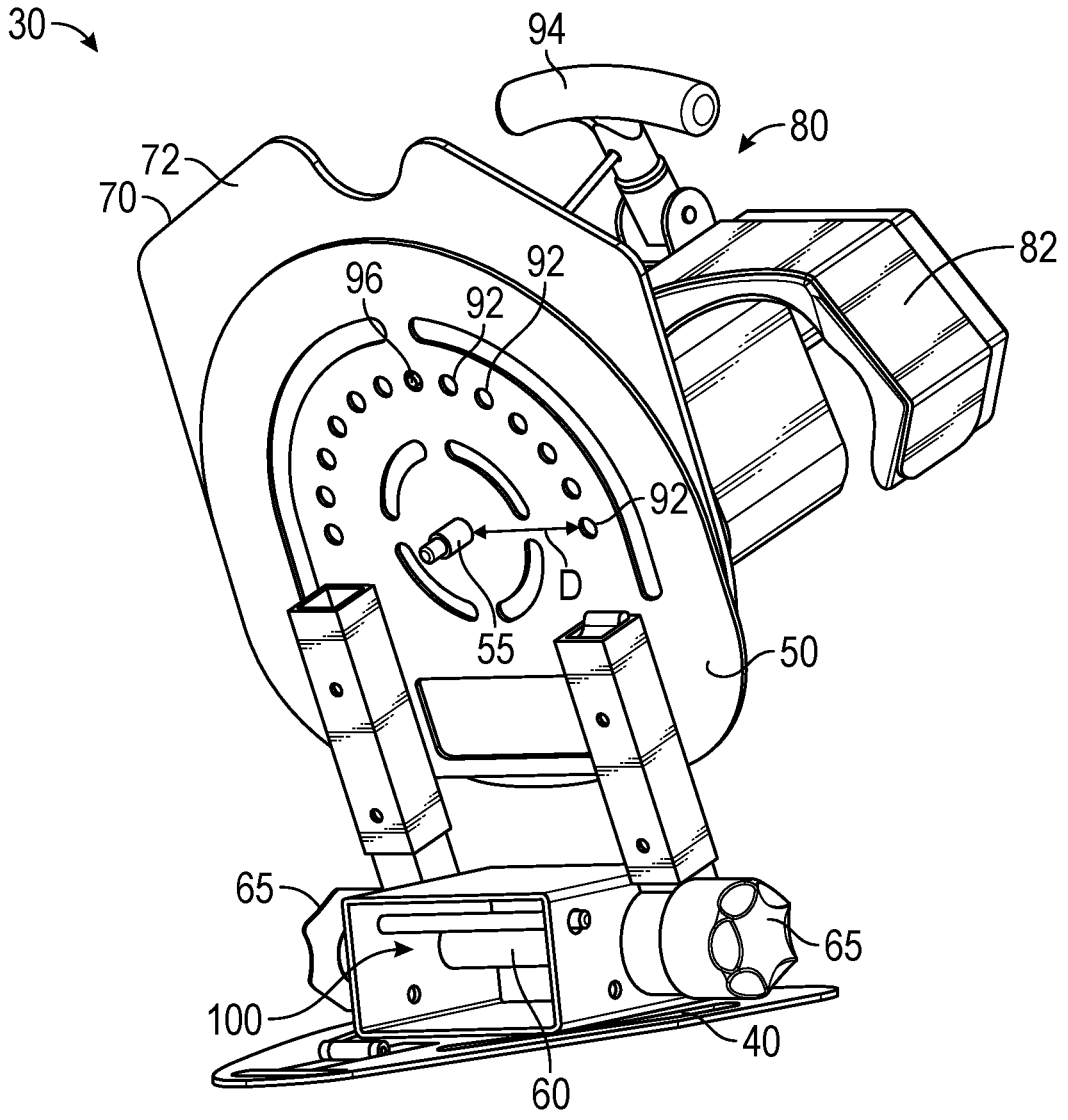
FIG. 3 is a rear perspective view of an alternate embodiment of the foot docking station of the invention.

FIGS. 1-3 illustrate an exercise apparatus 10 for use by a person 20 on a support surface 15, such as a floor. A foot docking station 30 comprises a rigid, preferably metallic base plate 40 pivotally fixed to a rigid, preferably metallic back plate 50 at a hinge 60. The back plate 50 includes a central pivot 55 rotationally fixed with a bottom side 72 of a rigid, preferably metallic foot plate 70. The rotational hinge 60 preferably includes a selectively adjustable tightening knob 65 (FIG. 2) adapted to frictionally lock the rotational position of the back plate 50 and foot plate 70 with the base plate 40. In one embodiment, radially-aligned sawtooth teeth (not shown), as is known in the art, within the rotational hinge 60 provide for discrete angular adjustment of the foot plate 70 with the base plate 40 in increments of 8 to 10-degrees. As such, the rotational position of the back plate 50 and foot plate 70 with the base plate 40 may be selectively set if desired by the person 20.

The foot plate 70 has a shin engagement mechanism 80 extending away from a top side 78 thereof for engaging the shins 22 of the person 20 while the person's feet 24 contact the top side 78 of the foot plate 70 or a cushion 79 affixed thereto. The shin engagement mechanism 80 includes a pair of U-shaped shin pads 82 projecting laterally away therefrom (FIG. 4, which has one of the shin pads 82 omitted for clarity of illustration). Optionally the cushioned shin pads 82 may be fixed on a shin pad trolley 84 that is adjustably moved closer or farther away from the foot plate 70 with a trolley movement mechanism 86 that may include a threaded rod 88 and a rotational knob 89, or other similar mechanism for moving the pair of shin pads 82 up and down with respect to the foot plate 70.

Preferably the base plate 40 and foot plate 70 further include a rotational locking mechanism 90 adapted for selectively locking the relative rotational position between the back plate 40 and the foot plate 70. Such a rotational locking mechanism 90 may include, for example, a plurality of locking apertures 92 each arranged a common distance D from the central pivot 55 and a release lever 94 and pin 96 arrangement fixed with the foot plate 72 and biased to urge the pin 96 into one of the locking apertures 92. As such, pulling the release lever 94 upward pulls the pin 96 out of the locking aperture 92 to allow the foot plate 70 to rotate about the pivot 55 with respect to the back plate 50. The release lever 94 may be set in a fully retracted position (not shown) if desired so that the foot plate 70 freely rotates on the back plate 50 during exercising.

Preferably the base plate 40 further includes a weight rod 49 (FIG. 1) projecting upwardly therefrom and adapted to receive at least one annular weight 16 thereon. Alternately, a door or other heavy item (not shown) may be engaged with the weight rod 49 or base plate 40 to maintain the base plate 40 on the support surface 15. The weight rod 49 may be pivoted down into alignment with the base plate 40 if desired (FIG. 4).

Figure 4:
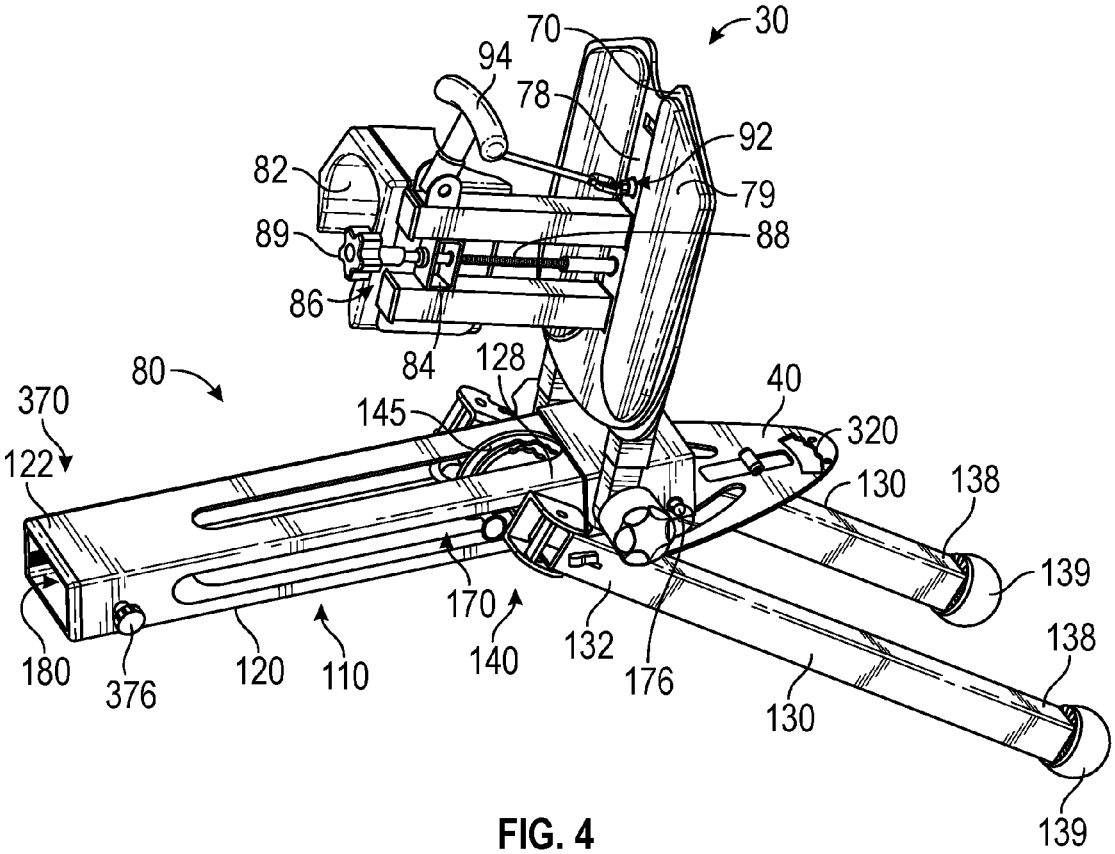
FIG. 4 is a perspective view of FIG. 3 with an added lower bench assembly, showing a first embodiment of legs of the invention, and illustrated with one shin guard omitted for clarity of illustration of a shin guard position adjustment mechanism.

Preferably the foot docking station 30 further includes a first receiver 100 and the exercise apparatus 10 further includes a lower bench 110 (FIG. 4). The lower bench comprises a rigid, preferably metallic, elongated lower shaft 120 having a distal end 128 adapted for engaging the first receiver 100 of the foot docking station 30, and a proximal end 122.

Figure 12A:
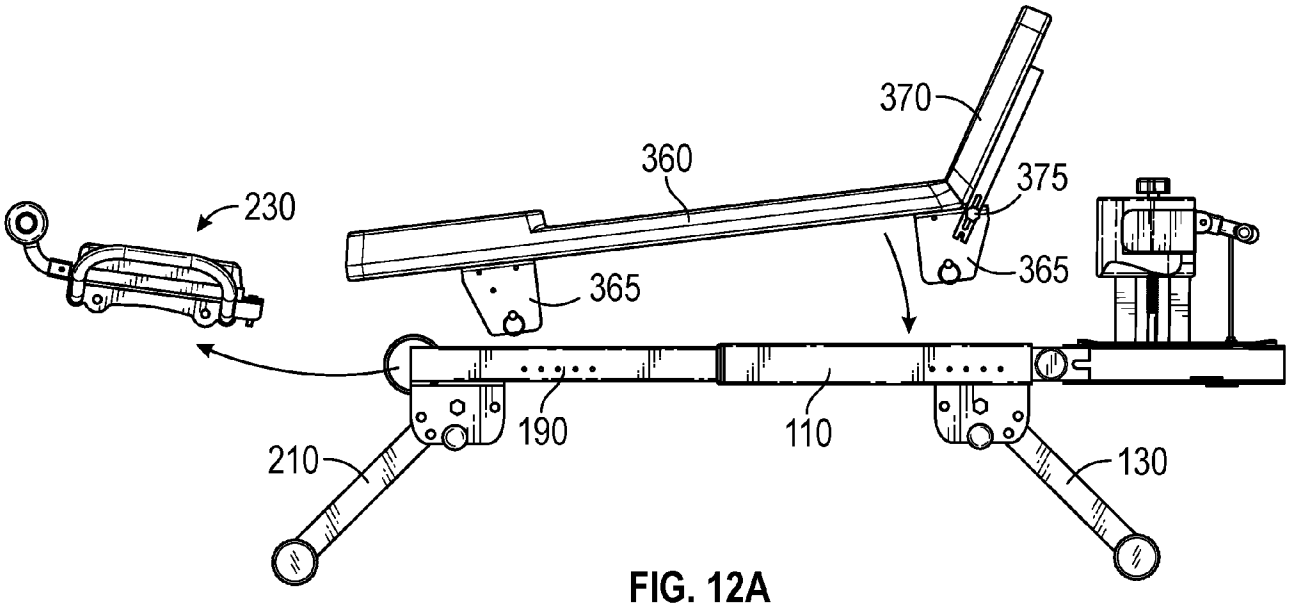
FIG. 12A is a side elevational view, showing the invention being moved from a first configuration into a second configuration with the removal of a bench trolley and the replacement thereof of with a long bench.
Figure 12B:
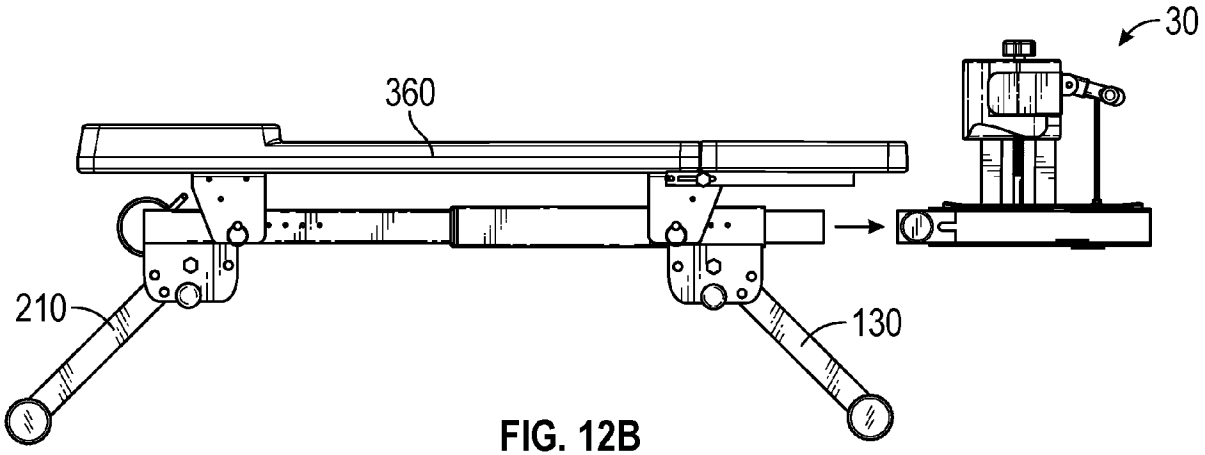
FIG. 12B is a side elevational view of the invention in the second configuration and with the foot docking station removed.
Figure 12C:
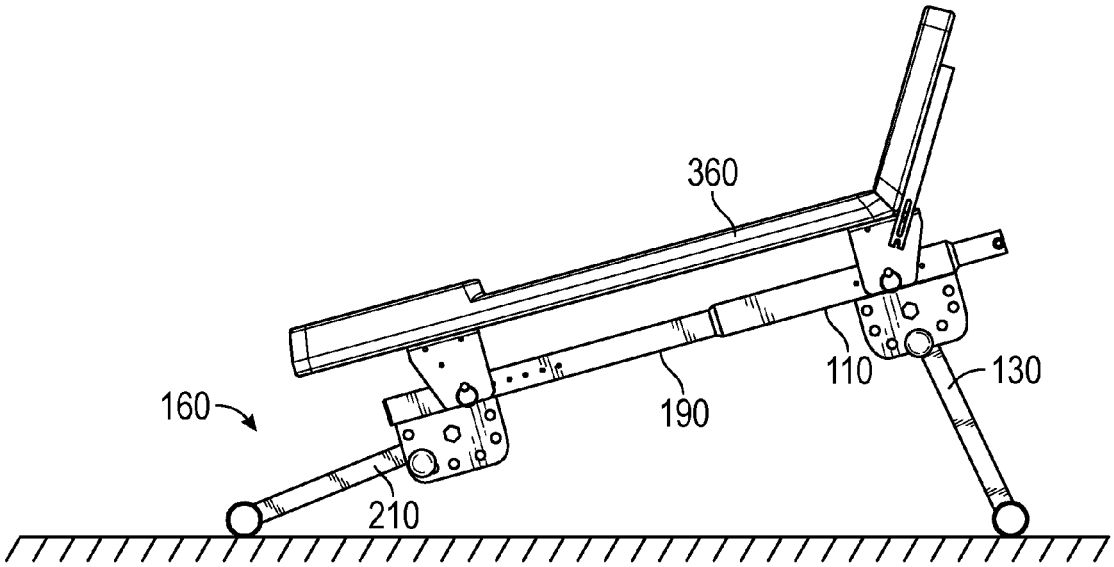
FIG. 12C is a side elevational view of the invention, illustrated with the proximal legs in a fully extended position and with the distal legs at an approximately 90-degree angle with respect to the bench.
Figure 12D:
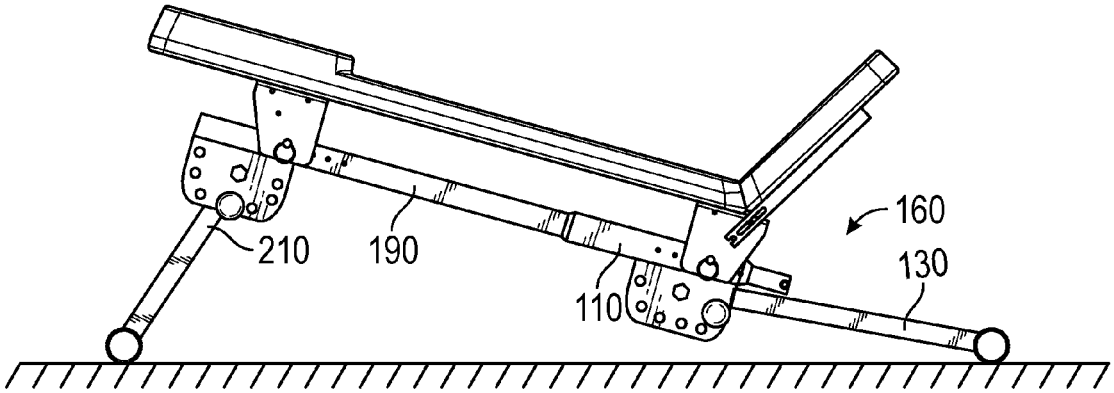
FIG. 12D is a side elevational view of the invention, illustrated with the distal legs in a fully extended position and with the proximal legs at an approximately 90-degree angle with respect to the bench, and further illustrating a seat back as attached with the bench.

In one embodiment, each of two rigid distal legs 130 is fixed with the distal end 128 of the lower shaft 120 at a rotational leg mount 140 (FIGS. 4-6 and 13A-13C). The distal legs 130 are positionable between a retracted position 150 (FIG. 13C) with aligned with and adjacent to the lower shaft 120, and an extended position 160 extending beyond the distal end 128 of the lower shaft 120 (FIG. 12D). The rotational leg mount 140 includes a rotational lock 142 adapted for selective locking of the relative rotational position of the legs 130 and the lower shaft 120. The legs 130 preferably each terminate at a distal end 138 thereof with a surface grip 139. As such, with the proximal end 122 of the lower shaft 120 and the surface grips 139 of each leg 130 contacting the support surface 15, the height and angle of the foot docking station 30 and the lower bench 110 may be selected for performing the exercise.

The rotational lock 142 of the rotational leg mount 140, the first embodiment of the legs 130, includes an axle 144 (FIG. 5) fixed between the proximal end 132 of each leg 130. The axle 144 includes a locking plate 145 through which a spring-biased pin 146 can engage any one of a plurality of pin stops 147 to selectively lock the relative rotational position of the legs 130 and the lower shaft 120.

Figure 5:
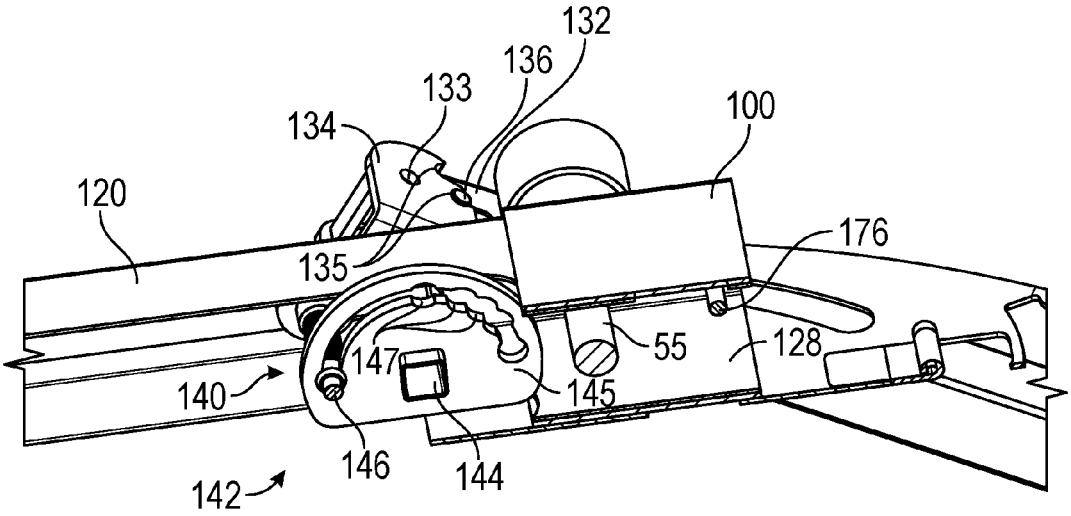
FIG. 5 is a perspective view of a rotational leg mount of FIG. 4, partially cut-away to reveal locking plate and pin arrangement.
Figure 6:
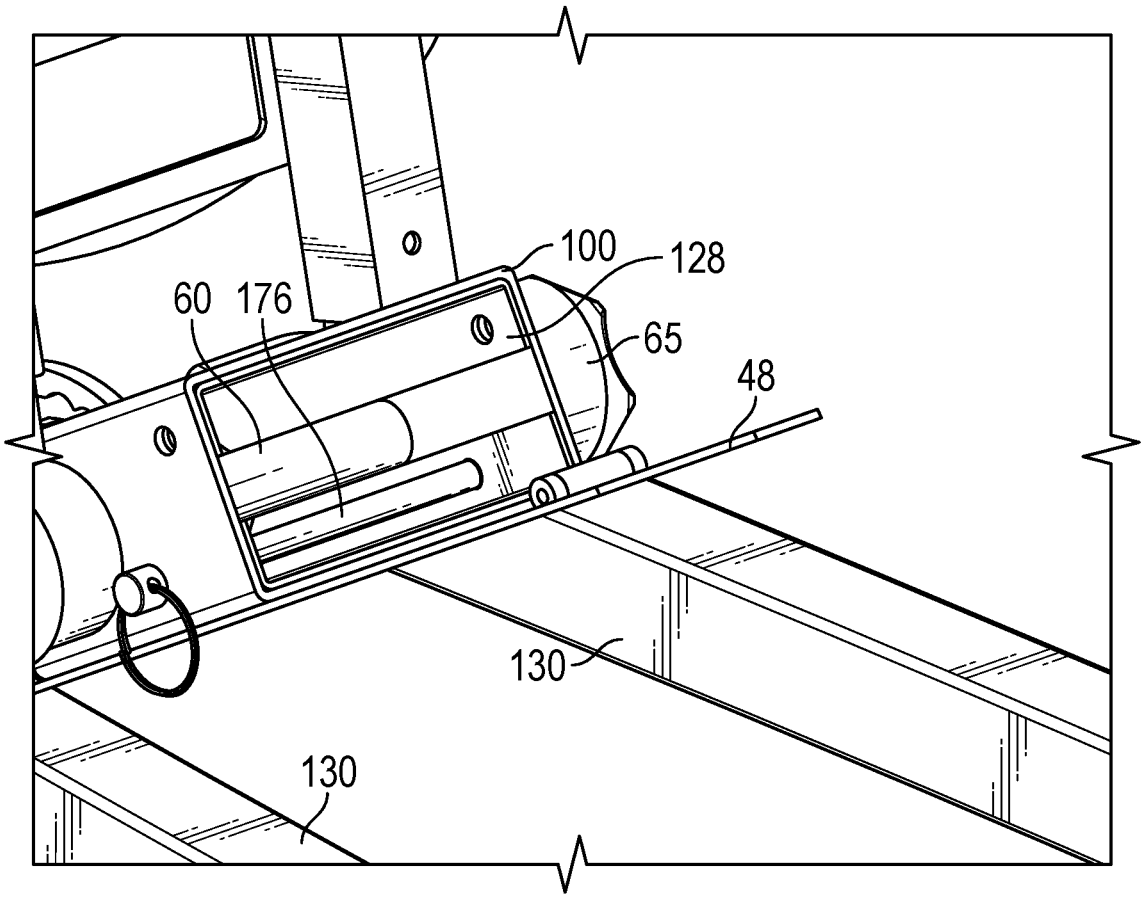
FIG. 6 is a partial perspective view of a distal end of a lower shaft of the lower bench.
Figure 7:
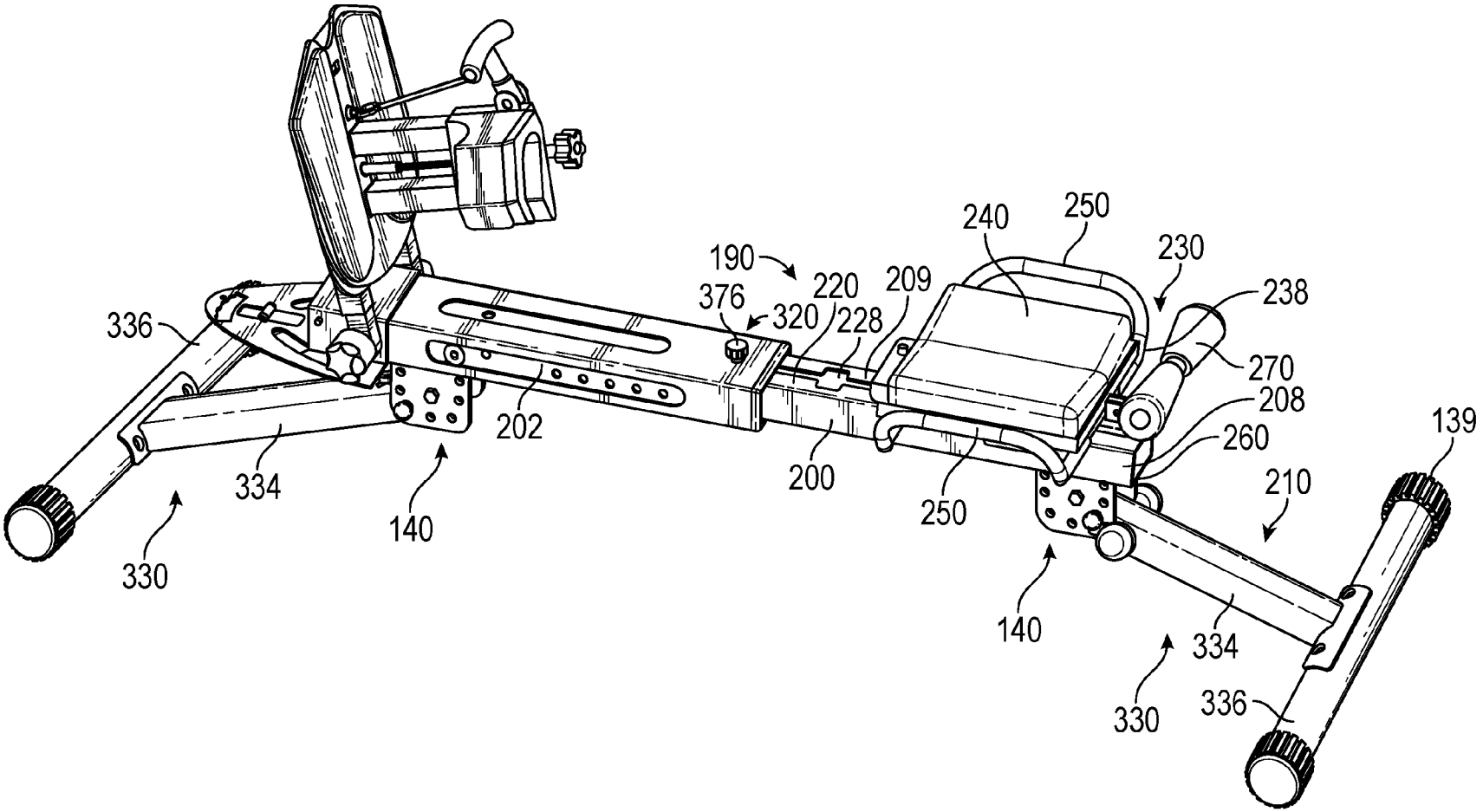
FIG. 7 is a perspective view of FIG. 4 with an added upper bench assembly, and further showing a second embodiment of the legs of the invention.
Figure 13A:
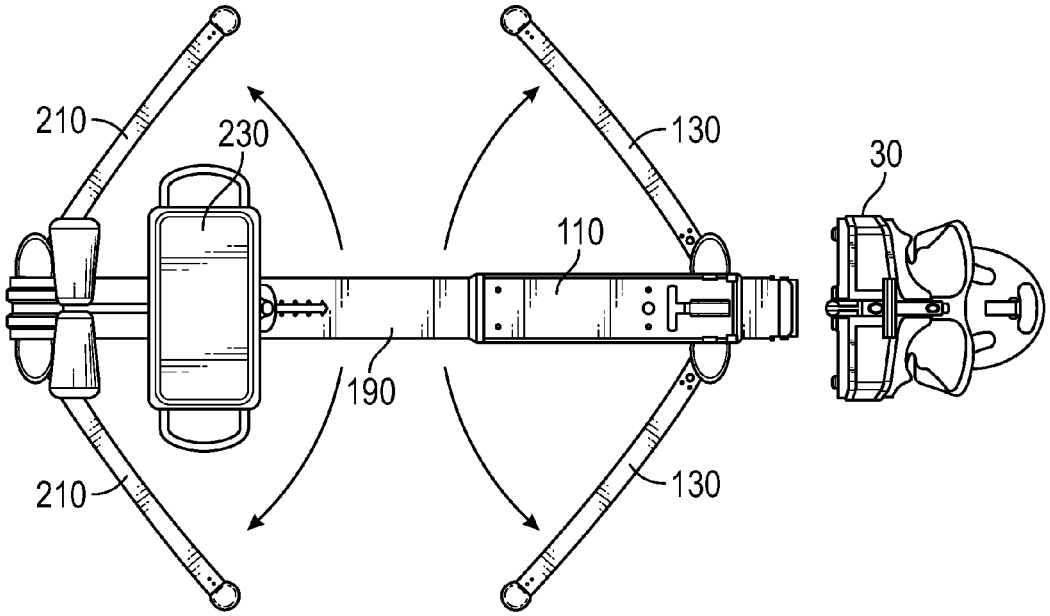
FIG. 13A is a top plan view of the invention having the first embodiment of the legs, and illustrating the legs partially angled away from the bench.
Figure 13B:
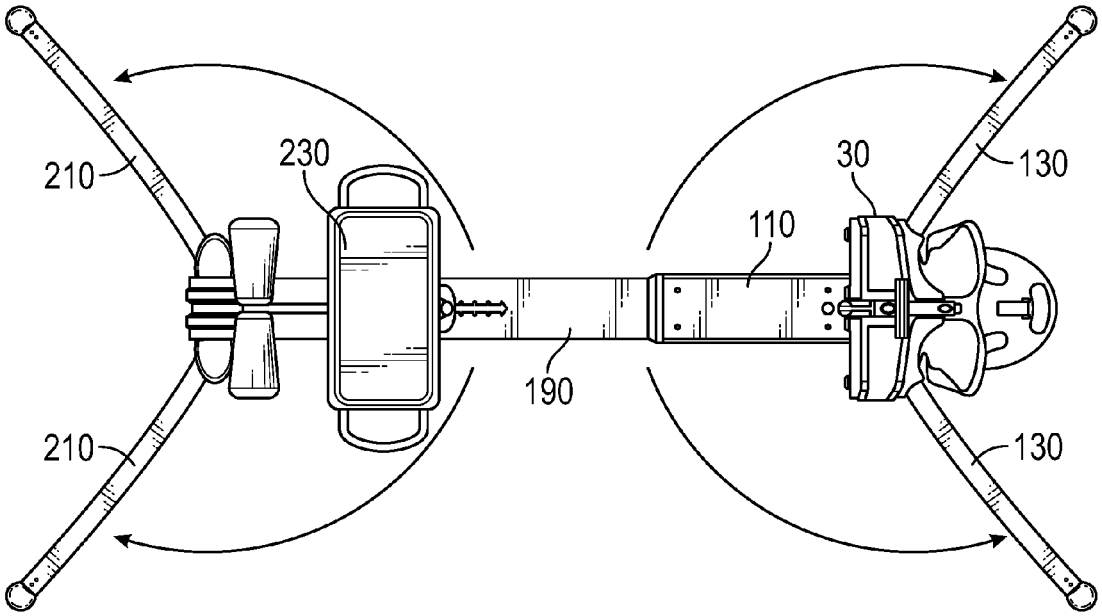
FIG. 13B is a top plan view of the invention as illustrated in FIG. 13A, showing the legs further angled away from the bench.

The first embodiment of the distal legs 130 may also include, at the proximal end 132 of each distal leg 130, a vertical pivot 133 adapted to allow the distal leg 130 to pivot laterally outwardly away from the distal end 128 of the lower shaft 120 (FIGS. 5, 13A, 13B). The vertical pivot 133 is captured within a pivot housing 134 that may further include a plurality of pin stops 135. In such an embodiment, the proximal end 132 of each leg 130 further includes a spring-biased pin 136 adapted for engaging any of the plurality of pin stops 135 of the pivot housing 134 to selectively lock the pivoting position of the leg 130 with respect to the lower shaft 120.

In a second and preferred embodiment of the legs 130 of the invention (FIGS. 7-12D), the pair of legs 130 takes the form of a single T-shaped leg 330 having a main shaft 334 and two laterally projecting shafts 336. An axle 333 traverses a proximal end 332 of the T-shaped leg 330 and a pivot aperture (not shown) v of a second pivot housing 340. The pivot housing 340 further includes at least one locking plate 346 through which a locking pin 350 can engage any one of a plurality of pin stops 347 to selectively lock the relative rotational position of the T-shaped leg 330 and the lower shaft 120.

The distal end 128 of the lower shaft 120 and the first receiver 100 of the foot docking station 30 may include a pin locking mechanism 170 (FIGS. 6 and 12B), such that a locking pin 176 may be selectively used to lock the foot docking station 30 to the distal end 128 of the lower shaft 120.

Preferably the proximal end 122 of the lower shaft 120 of the lower bench 110 further includes a second receiver 180 for engaging an upper bench 190 (FIGS. 7-13C). A rigid, preferably metallic, elongated upper shaft 200 has a distal end 208 adapted for engaging the second receiver 180 of the lower shaft 120, and a proximal end 202. At least one proximal leg 210 is fixed with the proximal end 202 of the upper shaft 200 at a rotational leg mount 140 at a proximal end 212 thereof, identically to either the first or second embodiment of the at least one distal leg 130 except oriented 180-degrees such that the at least one proximal leg 210 may extend beyond the proximal end 202 of the upper shaft 200 when in its extended position 160. Each proximal leg 210 terminates at a distal end 218 thereof with the surface grip 139.

In such an embodiment, the distal end 208 of the upper shaft 200 and the second receiver 180 of the lower shaft 120 include a second pin locking mechanism 370 (FIG. 7), such that a locking pin 376 may be used to selectively lock the proximal end 122 of the lower shaft 120 to the distal end 208 of the upper shaft 200.

Figure 8:
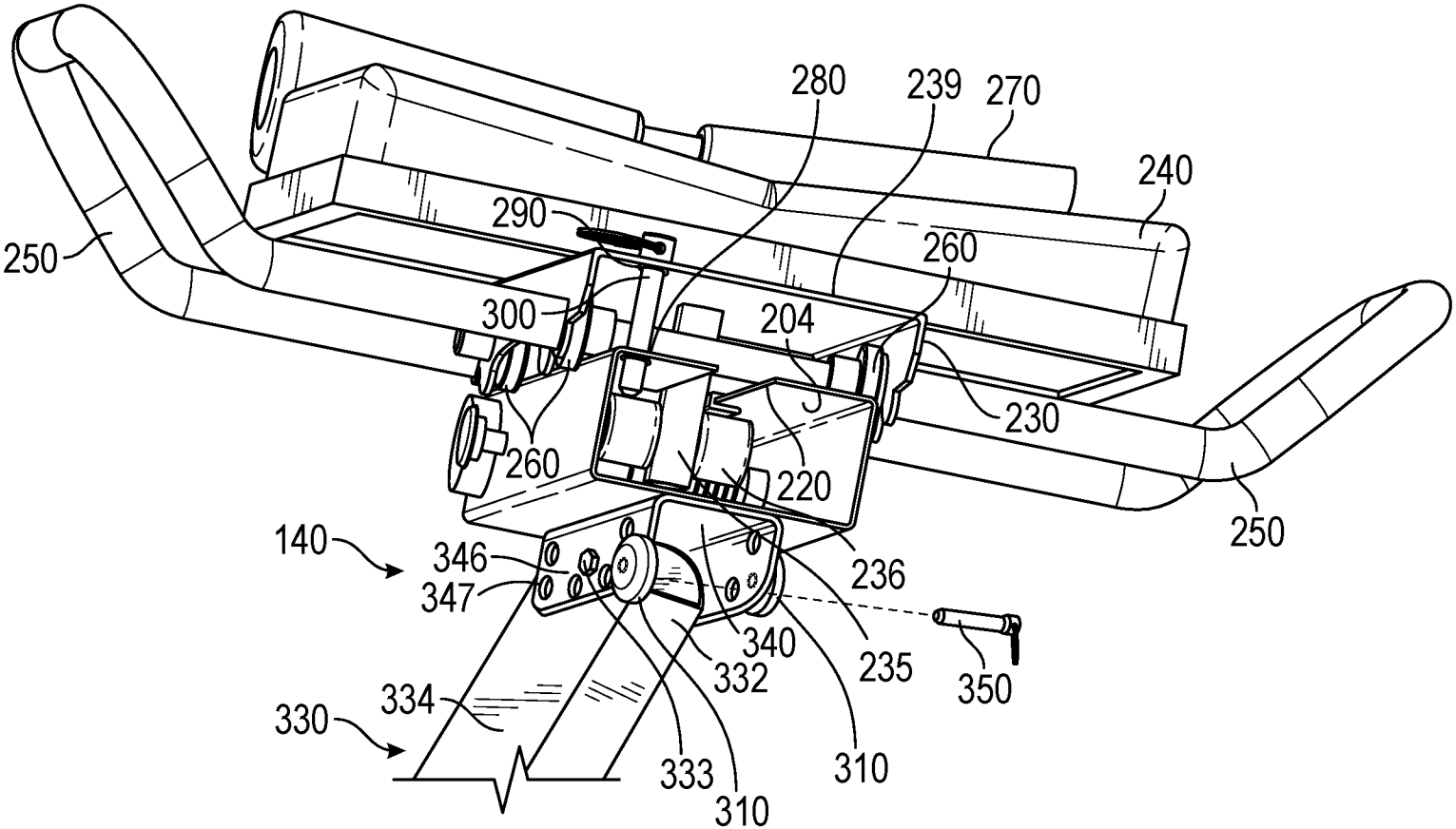
FIG. 8 is a partial perspective view of a proximal end of the upper bench.
Figure 9:
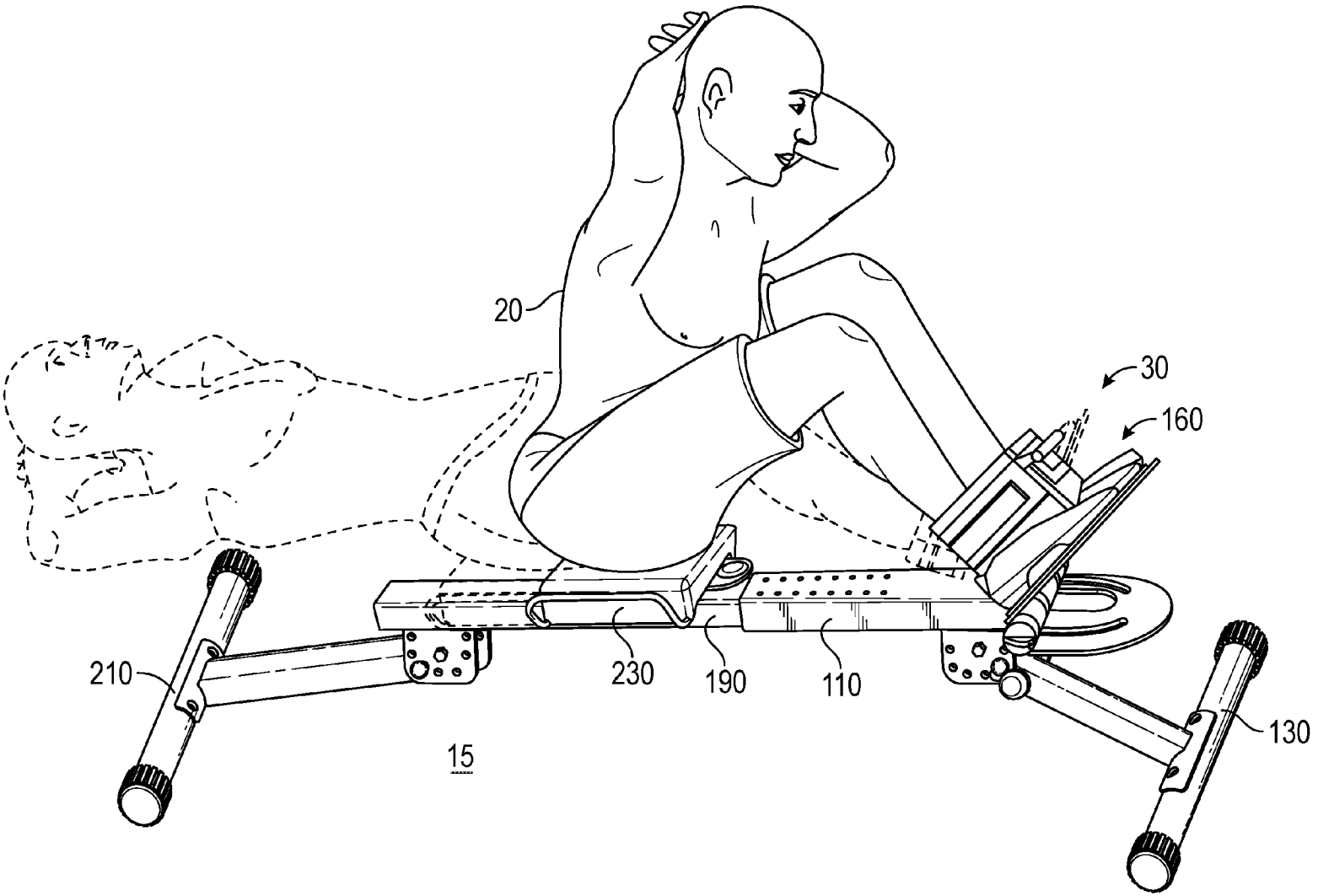
FIG. 9 is a perspective view of the invention of FIG. 7, illustrated as in-use by the exerciser in a first configuration.
Figure 10:
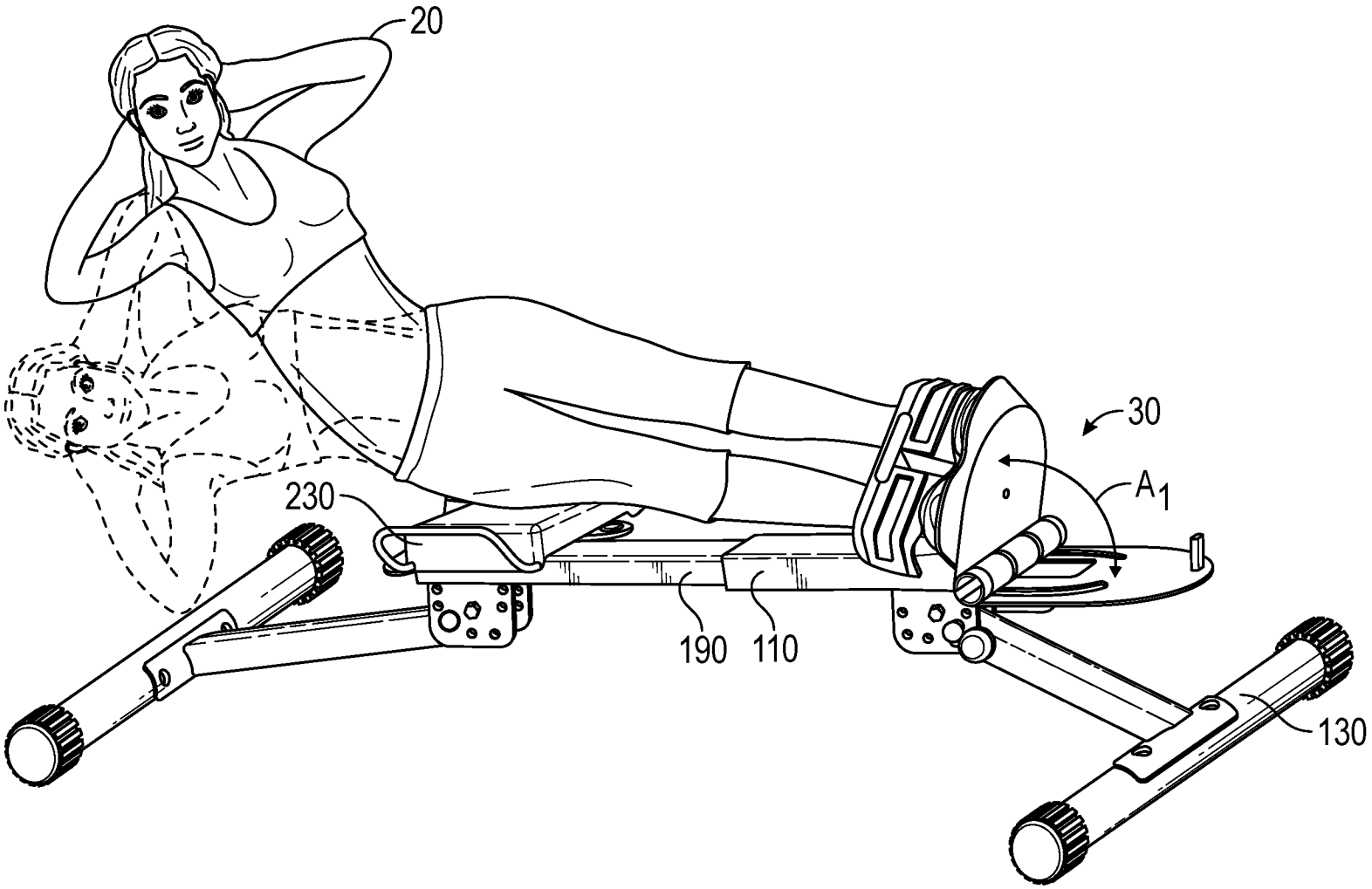
FIG. 10 is a perspective view of the invention of FIG. 7, illustrated as in-use by the exerciser with the foot docking station rotated 90-degrees.

A top side 209 of the upper shaft 200 includes a track 220 upon which a bench trolley 230 slides between the proximal and distal ends 202,208 of the upper shaft 200. The bench trolley 230 includes at least one cushion 240 at a top side 239 thereof, a pair of laterally extending handles 250, and at least a first pair of wheels 260 that engage the track 220 (FIG. 8). The bench trolley 230 may further include a lumbar support cushion 270 (FIG. 11) extending away from a distal side 238 thereof.

The track 220 preferably includes a plurality of locking apertures 280 (FIG. 8) and the bench trolley 230 includes a pin aperture 290. As such, the bench trolley 230 can be locked into position with respect to the track 220 by inserting a locking pin 300 through the pin aperture 290 of the bench trolley 230 and one of the plurality of locking apertures 280 of the track 220. The track 220 further may include at least one pair of wheel cut-outs 228, the bench trolley 230 including a wheel post 235 extending through the track 220 of the upper shaft 200 and terminating in a second pair of wheels 236 that engage an inside surface 204 of the upper shaft 200. As such, when the second pair of wheels 236 are aligned with the cut-outs 228 the bench trolley 230 can be removed from the upper bench 190.

Figure 11:
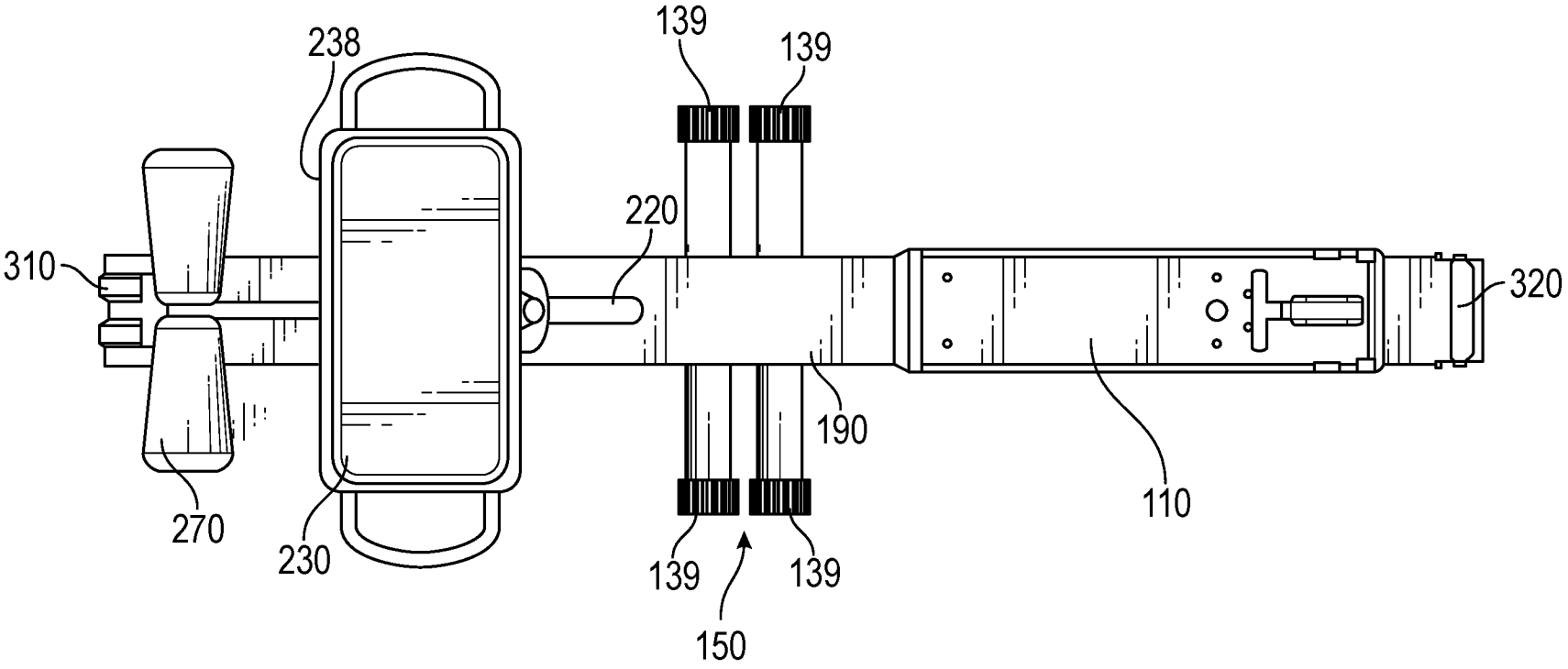
FIG. 11 is a top plan view of the invention, illustrated with the legs thereof in a fully retracted position.

Preferably a third pair of wheels 310 extends past the proximal end 202 of the upper shaft 200. The foot docking station 30, in such an embodiment, includes a pulling handle 320 (FIGS. 4 and 7) formed in a distal end 48 of the base plate 40. As such, with the proximal and distal legs 210,130 each in their retracted positions 150, the pulling handle 320 of the foot docking station 30 may be lifted and pulled to roll the apparatus 10 along the support surface 15 upon the third pair of wheels 310. Similarly, the distal end 128 of the lower shaft 120 may also include one of the pulling handles 320 such that the apparatus 10 may be rolled along the support surface 15 even if the foot docking station 30 is removed from the lower shaft 120 (FIG. 11).

An auxiliary bench 360 (FIGS. 12A-12D) may be attached to the upper and lower benches 190,110 by removing the bench trolley 230 and, optionally, the foot docking station 30. The auxiliary bench 360 may be selectively attached to the upper and lower benches 190,110, or to the track 220, at a pair of mechanical fasteners 365. As such, by positioning the proximal and distal legs 210,130 in their various positions, the auxiliary bench 360 may be reclined, inclined, or level. An optional pivotal seat section 370 may be included at the distal end of the auxiliary bench 360 and separably inclined with respect to the auxiliary bench 360, or rotated to become aligned with the auxiliary bench 360 (FIG. 12B). A bracket and knob mechanism 375 is included for selectively positioning the rotation of the seat section 370 with respect to the auxiliary bench 360.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. An exercise apparatus for use by a person on a support surface, the apparatus comprising:

a foot docking station comprising a base plate pivotally fixed to a back plate at a hinge, the back plate including a central pivot rotationally fixed with a bottom side of a foot plate, the foot plate having a shin engagement mechanism extending away from a top side thereof for engaging the shins of the person while the person's feet contact the top side of the foot plate, the shin engagement mechanism including a pair of U-shaped shin pads projecting laterally away therefrom;

whereby with the base plate fixed with the support surface and the person's feet contacting the foot plate, the foot plate may be rotated by the person to a desired rotational orientation for performing an exercise on the support surface.

2. The exercise apparatus of claim 1 wherein the rotational hinge includes a selectively adjustable tightening knob adapted to frictionally lock the rotational position of the back plate and foot plate with the base plate.

3. The exercise apparatus of claim 1 wherein the back plate and foot plate further include a rotational locking mechanism adapted for selectively locking the relative rotational position between the back plate and the foot plate.

4. The exercise apparatus of claim 3 wherein the rotational locking mechanism includes a plurality of locking apertures each arranged a common distance from the central pivot, and a release lever and pin arrangement fixed with the foot plate and biased to urge the pin into one of the locking apertures, whereby pulling the release lever upward pulls the pin out of the locking aperture to allow the foot plate to rotate about the pivot with respect to the back plate.

5. The exercise apparatus of claim 1 wherein the base plate further includes a weight rod projecting upwardly therefrom and adapted to receive at least one annular weight, whereby the apparatus is weighted to the support surface by the at least one annular weight.

6. The exercise apparatus of claim 1 wherein the foot docking station further includes a first receiver, and wherein the exercise apparatus further includes a lower bench comprising:

an elongated lower shaft having a distal end adapted for engagement with the first receiver of the foot docking station and a proximal end, at least one distal leg fixed with the distal end of the lower shaft at a rotational leg mount, the at least one distal leg positionable between a retracted position aligned with and adjacent to the lower shaft, and an extended position aligned with the lower shaft and extending beyond the distal end of the lower shaft, the rotational leg mount including a rotational lock adapted for selective locking of the relative rotational position of the at least one distal leg and the lower shaft, the at least one distal leg terminating at a distal end thereof with a surface grip;

whereby with the proximal end of the lower shaft and the surface grip of the at least one distal leg contacting the support surface, the height and angle of the foot docking station may be established for performing the exercise on the support surface.

7. The exercise apparatus of claim 6 wherein the distal end of the lower shaft and the first receiver of the foot docking station include a pin locking mechanism, whereby a locking pin may be selectively used to lock the foot docking station to the distal end of the lower shaft.

8. The exercise apparatus of claim 6 wherein the rotational lock of the rotational leg mount includes an axle traversing the proximal end of the at least one distal leg, the rotational lock including a locking plate through which a pin can engage any one of a plurality of pin stops to selectively lock the relative rotational position of the at least one distal leg and the lower shaft.

9. The exercise apparatus of claim 6 wherein the proximal end of the lower shaft of the lower bench further includes a second receiver, and wherein the exercise apparatus further includes an upper bench comprising:

an elongated upper shaft having a distal end adapted for engaging the second receiver of the lower shaft, and a proximal end, at least one proximal leg fixed with the proximal end of the upper shaft at a rotational leg mount, the at least one proximal leg positionable between the retracted position aligned with and adjacent to the upper shaft, and the extended position aligned with the upper shaft and extending beyond the proximal end of the upper shaft, the rotational leg mount including the rotational lock adapted for selective locking of the relative rotational position of the at least one proximal leg and the upper shaft, the at least one proximal leg terminating at a distal end thereof with the surface grip;

whereby with the surface grips of the at least one proximal leg contacting the support surface, the height and angle of the foot docking station and upper and lower bench may be established for performing the exercise on the apparatus.

10. The exercise apparatus of claim 9 wherein the proximal end of the upper shaft and the second receiver of the lower shaft include a second pin locking mechanism, whereby a locking pin may be selectively used to lock the proximal end of the lower shaft to the distal end of the upper shaft.

11. The exercise apparatus of claim 9 wherein the rotational lock of the rotational leg mount of the upper shaft includes the axle traversing a proximal end of the at least one proximal leg, the rotational lock including the locking plate through which the pin can engage any one of the plurality of pin stops to selectively lock the relative rotational position of the at least one proximal leg and the upper shaft.

12. The exercise device of claim 9 wherein a top side of the upper shaft includes a track upon which a bench trolley slides between the proximal and distal ends of the upper shaft, the bench trolley including at least one cushion at a top side thereof, a pair of laterally extending handles, and at least a first pair of wheels that engage the track.

13. The exercise device of claim 12 wherein the bench trolley further includes a lumbar support cushion extending away from a distal side thereof.

14. The exercise device of claim 12 wherein the track includes a plurality of locking apertures and the bench trolley includes a pin aperture, such that the bench trolley can be locked into position with respect to the track by inserting a locking pin through the pin aperture of the bench trolley and one of the plurality of pin apertures of the track.

15. The exercise device of claim 12 wherein the track includes at least one pair of wheel cut-outs and wherein the bench trolley includes a wheel post extending through the track of the upper shaft and terminating in a second pair of wheels that engage an inside surface of the upper shaft, such that when the second pair of wheels are aligned with the cut-outs the bench trolley can be removed from the upper bench.

16. The exercise device of claim 9 wherein a pair of wheels extends past the proximal end of the upper shaft, and wherein the foot docking station includes a pulling handle formed in a distal end of the base plate, such that with the proximal and distal legs in their retracted positions, the pulling handle of the foot docking station may be lifted and pulled to roll the apparatus along the support surface upon the pair of wheels.

17. The exercise device of claim 9 wherein a pair of wheels extends past the proximal end of the upper shaft, and wherein the distal end of the lower shaft includes a pulling handle formed therein, such that with the proximal and distal legs in their retracted positions, the pulling handle of the lower shaft may be lifted and pulled to roll the apparatus along the support surface upon the pair of wheels.

* * * * *